US005507484A

United States Patent [19]

van Nimwegen et al.

[11] Patent Number: 5,507,484

[45] Date of Patent: Apr. 16, 1996

[54] BASKETBALL BACKBOARD

[75] Inventors: Edward G. van Nimwegen, North Ogden; David C. Winter, Layton, both of Utah

[73] Assignee: Lifetime Products, Inc., Clearfield, Utah

[21] Appl. No.: 276,032

[22] Filed: Jul. 15, 1994

[51] Int. Cl.[6] ..... A63B 63/08

[52] U.S. Cl. ..... 273/1.5 R

[58] Field of Search ..... 273/1.5 R, 1.5 A; 52/309.7, 309.11, 807, 309.8, 309.9

[56] References Cited

U.S. PATENT DOCUMENTS

| | | | |
|---|---|---|---|
| 4,078,348 | 3/1978 | Rothman | 52/309.7 |
| 4,145,044 | 3/1979 | Wilson et al. | 273/1.5 |
| 4,412,679 | 11/1983 | Mahoney et al. | 273/1.5 |
| 4,424,968 | 1/1984 | Smith | 273/1.5 R |
| 4,726,707 | 2/1988 | Newton | 52/309.11 |
| 5,346,207 | 9/1994 | Heinen | 273/1.5 R |

FOREIGN PATENT DOCUMENTS

| | | | |
|---|---|---|---|
| 150971 | 9/1982 | Japan | 273/1.5 R |

OTHER PUBLICATIONS

Huffy Sports, "Our All–Lineup," pp. 23, 27.
Lifetime Products, Inc., "Institutional Basketball Equipment," p. 6.
Porter, "Celebrating 100 Years of Basketball," pp. 6, 7, 9, 10.
Fisher Price, "Adjustable Basketball Standard," Jun., 1993.
Little Tikes, "Adjustable Basketball Standard," Jun., 1993.
Todays' Kids, "Adjustable Basketball Standard,"0 Jul. 1992.

*Primary Examiner*—Mark S. Graham
*Attorney, Agent, or Firm*—Madson & Metcalf

[57] ABSTRACT

A preferred embodiment of a basketball backboard is blow-molded from polyethylene. The backboard includes a front layer, a back layer, a plurality of offsets, and an edge wall which are homogeneously secured to one another during the blow-molding process and which together define an interior volume that is substantially filled with air, polyurethane foam, or another fill material. The front layer has a medium-to-large sized flat face for receiving basketball impacts. The back layer is spaced apart from the front layer by the offsets. A variety of differently shaped and positioned offsets are employed. Two T-shaped offsets are positioned alongside a location at which a hoop may be mounted to the backboard. Quadrilateral-shaped and other offsets are positioned relative to mounting sites for mounting the backboard to a backboard support such as a pole or wall. The mounting sites define a triangle whose sides correspond to lines of high stress within the backboard. The offsets are positioned such that each side of the triangle is perpendicular to at least one offset. Offsets are also positioned parallel to one another, and in perpendicular or transverse groups. To assist in stacking such backboards atop one another, a stacking groove in the front layer of one backboard releasably engages corresponding stacking stubs which extend from the back layer of an adjacent backboard.

35 Claims, 3 Drawing Sheets

BASKETBALL BACKBOARD

FIELD OF THE INVENTION

The present invention relates to molded basketball backboard, and more particularly to a light-weight basketball backboard which is molded in a shape that provides the backboard with strength, rigidity, and consistent rebound play, and which permits secure placement of the backboard in a compact shipping container as part of a portable basketball system.

TECHNICAL BACKGROUND OF THE INVENTION

A variety of portable basketball systems are commercially available. One portable system, described in U.S. Pat. No. 5,248,140 issued to Matherne et al., provides several important advantages. The system includes a pole attachable to a backboard at one end and to a hollow ballast-receiving base at the other end. In the system's assembled state, several pole sections are joined to form the pole, and a basketball goal ("hoop") is mounted on the backboard. The base is filled with a ballast such as water or sand to provide stability to the assembled system.

In the system's disassembled state, the base is emptied of ballast, making the system light in weight and hence facilitating easier and more cost-effective storage and shipping. The base is shaped with contours that receive and retain the system's backboard, goal, and pole sections when the disassembled system is packed within a shipping container. The base contours impede shifting movement of the system parts within the container during shipping, thereby reducing the risk of damage to the system during transit. The base contours also permit the entire system to be packed for shipment in a relatively flat shipping carton, thereby reducing the space required to hold the disassembled system.

Basketball backboards for either portable or fixed-in-place basketball systems may be formed with a variety of materials and processes. Backboards formed of wood, steel, acrylic, graphite, aluminum, and fiberglass are all known in the art. Manufacturing processes such as injection-molding, blow-molding, and other molding methods, as well as bonding, cutting, and coating processes are also well-known.

Regardless of the material and processes used, or the type of basketball system a backboard is meant for use with, several backboard qualities are important. The materials and processes used in forming a backboard preferably have a relatively low cost, provide easy shaping of the board during its manufacture, create a board that is strong, impact-resistant, and weather-resistant, and provide uniform rebounds from the finished backboard. In addition, a backboard which is part of a portable basketball system is preferably light-weight to facilitate portability and to reduce shipping costs.

Wood was originally the material of choice for forming backboards, because it has a relatively low cost and may be easily shaped during manufacturing. Indeed, the tools required to shape a wooden backboard are readily available even to household consumers. Wood also has sufficient strength, rigidity, and impact-resistance to serve as a backboard when laminated into sufficiently thick plywood sheets. However, wood is much less weather-resistant than materials such as acrylic, graphite, and fiberglass. Nor are the necessarily thick wooden backboards light-weight enough to be attractive for use in portable basketball systems.

Although steel backboards are strong and rigid, they are relatively difficult and expensive to manufacture. For instance, costly specialized machinery is required to shape steel into backboards. Steel also rusts, so a protective coating must be applied to a steel backboard to maintain the backboard's attractive appearance if the backboard is exposed to the weather, as many backboards are. The addition of such a coating increases both material and manufacturing costs. Moreover, steel is a heavy material and therefore is not favored for use in portable basketball systems.

Fiberglass is relatively inexpensive, easy to shape, light-weight, and weather-resistant. Unfortunately, fiberglass is not sufficiently impact-resistant to withstand prolonged and vigorous use. Acrylic and graphite materials are both impact-resistant, they each weather well, and they are easily shaped by conventional processes such as injection-molding or resin transfer molding. Acrylic and graphite materials are also relatively light-weight. However, these materials are significantly more expensive than fiberglass. Each material is also heavy enough to encourage attempts to reduce the backboard's weight still further.

Accordingly, several designs attempt to provide a light-weight molded backboard which is nonetheless strong enough to resist extensive energetic play and which provides uniform rebounds. The simplest approach provides a backboard which is essentially a thick sheet of the material in question. The backboard has a flat front face spaced apart from a flat rear face. Except for holes used to mount the basketball goal to the backboard and to mount the backboard to the pole, the backboard is solid between the front face and the rear face.

Forming the backboard as a sheet facilitates manufacturing. However, the sheet must be relatively thick to provide sufficient strength for the backboard to withstand repeated impacts from a basketball. Because the sheet is solid, making the sheet thicker may significantly increase the weight of the backboard. The increased weight in turn increases the cost and effort required to ship or reposition a basketball system which includes the backboard.

Another approach forms the backboard as a hollow sheet. The backboard still has a flat front face and a flat rear face, but these faces are separated at least in part by a chamber within the sheet. By not including material everywhere within the sheet, this approach may substantially decrease the backboard's weight. However, the chamber also decreases rigidity. Such a backboard may flex rather than properly rebounding the basketball. Increasing the thickness of the front chamber wall will increase the backboard's rigidity but also increases its weight.

A variation on the hollow sheet approach is to fill the chamber with a material such as polyurethane foam which is lighter than the material used in the chamber walls but which nonetheless adds strength to the backboard. However, such fill materials tend to lose adhesion to the chamber walls over time and after repeated impacts from basketballs striking the backboard. Preferred fill materials may also add significantly to the backboard's cost.

One approach succeeds in reliably bonding a urethane layer between two thin outer walls of aluminum. This produces a "sandwich" backboard which is not substantially heavier than fiberglass and which provides consistent rebounds. However, both the materials and the tooling required make manufacturing such a backboard relatively expensive and time-consuming. Moreover, sandwich backboards may be permanently dented by impact with anything more rigid than a basketball, such as during shipping or installation.

In addition, any approach which makes the backboard a sheet with two flat faces, whether hollow or not, fails to take advantage of a critical difference between the two faces: the basketball normally hits only the front face. Thus, the rear face need not be flat.

Accordingly, a different approach forms a backboard from a wall of material which is thinner than typical sheet backboards formed with the same material. The front side of the wall has a flat face which receives the impact of basketballs during play. The rear side of the wall is not flat, but is instead reinforced by ribs in an effort to compensate for the loss of strength and rigidity caused by thinning the wall. The ribs are typically integral and unitary with the wall, and are typically molded in place when the wall is molded.

Various rib patterns are employed. One pattern is a simple X whose center is positioned near the center of the backboard. Although this pattern adds strength to the board, it does not provide relatively uniform rebound. Large sections of the backboard's front face are not directly reinforced by one of the ribs and therefore have less rigidity and a greater ability to absorb kinetic energy from the basketball. Thus, a basketball which strikes one portion of the face at a certain angle and velocity may rebound quite differently than would an identical basketball which strikes a different position on the face at the same angle and velocity. The resulting inconsistent rebounds are generally undesirable.

Another pattern includes a group of parallel ribs extending from one edge of the backboard to another edge. Such backboards tend to flex or break along the line of one or more ribs. A variation on the parallel rib pattern includes two or more groups of parallel ribs to create a rectangular or triangular grid of intersecting ribs. That is, the ribs in each group are substantially parallel to one another, and each group is transverse to another group. A pattern of this general type is illustrated in U.S. Pat. No. 3,788,642.

Regardless of the number of groups of parallel ribs used, the rib pattern in such backboards is substantially uniform across the entire backboard. In particular, no correction is made for the fact that portions of the backboard are anchored to the pole or to the hoop. Portions of the backboard near the mounting points of the pole and the hoop are reinforced by ribs placed in substantially the same pattern as the ribs that reinforce more distant portions of the backboard. The more distant backboard portions, which are reinforced by ribs but not directly anchored to a pole or hoop, therefore rebound differently than the portions which are both reinforced and anchored.

Other backboards therefore employ ribs arranged in a complex network of interconnected lines designed to provide consistent rebounds. Unfortunately, using ribs in any pattern limits the materials used in forming the backboard to those materials such as fiberglass, graphite, and steel which have sufficient tensile strength and rigidity for ribs to provide adequate reinforcement. Disadvantages of these materials are discussed above. Other materials, which have superior impact-resistance but lack sufficient rigidity for use in ribbed backboards, are unfortunately ruled out by the various ribbed backboard designs.

Thus, it would be an advancement in the art to provide a basketball backboard formed of a material which has better impact-resistance than fiberglass at a comparable weight and cost.

It would also be an advancement to provide such a backboard which gives consistent rebounds during play.

It would be an additional advancement to provide such a backboard which is weather-resistant.

It would also be an advancement to provide such a backboard which does not dent easily.

It would be a further advancement in the art to provide such a backboard which is easy to manufacture using conventional methods.

Such a basketball backboard is disclosed and claimed herein.

BRIEF SUMMARY OF THE INVENTION

The present invention provides a novel basketball backboard. In a preferred embodiment, the backboard is blow-molded from high-density polyethylene. Polyethylene has not been previously favored as the main structural component of medium-to-large sized basketball backboards because it is relatively flexible. However, the backboard of the present invention includes polyethylene which is formed into a shape that provides a strong, rigid backboard capable of giving consistent rebounds even when the backboard is large enough for use by adults.

A preferred embodiment of the present backboard includes a front layer, a back layer, a plurality of offsets, and an edge wall. The front layer, back layer, offsets, and edge wall are secured to one another and together define an interior volume which is substantially filled with a fill material.

The front layer has a relatively flat face configured for receiving the impact of a basketball. When the backboard is in use, a basketball goal ("hoop") is mounted to the face. The face may be formed in various sizes, including those normally used for adult basketball play.

The back layer is spaced apart from the front layer by the offsets. The offsets are spaced apart from the perimeters of the front and back layers to provide support throughout the face. One end of each offset is homogeneously secured to the back layer and the other end is homogeneously secured to the front layer. Homogeneous securement in the preferred embodiment is accomplished by forming the back layer, offsets, and front layer out of polyethylene during one blow-molding process and allowing these structures to connect while the polyethylene crystallizes and solidifies.

The interior volume of the backboard holds a fill material that is principally formed of a significantly different material than the front layer and the back layer. The presently preferred fill material is air at ambient pressure. In an alternative embodiment, the fill material is principally formed of polyurethane foam.

In the preferred embodiment, the back layer has substantially uniform thickness and the offsets are molded as deformations in an otherwise generally flat sheet of polyethylene. Each offset thus defines a corresponding depression in the back layer. In an alternative embodiment, the offsets are solid columns of polyethylene extending between the front layer and the back layer.

A variety of differently shaped and positioned offsets are employed in each backboard, including quadrilateral-shaped, rectangular-shaped, and T-shaped offsets. The shape of an offset refers generally to the shape of a ridge line or lines where the offset is homogeneously secured to the back layer or to the front layer. The ridge lines are located at positions which support the backboard's face and provide the backboard with consistent rebound capability.

Several ridge lines are positioned relative to connections between the backboard and the hoop or pole. For instance, two T-shaped offsets are positioned alongside a goal mounting aperture which is provided in the backboard for mounting the hoop to the backboard. Other offsets are positioned relative to mounting sites for mounting the backboard to a backboard support such as a pole or wall. The back layer of the backboard contains at least three such mounting sites; typically, these are bolt holes through the back and front layer of the backboard.

The mounting sites define a triangle whose sides correspond to lines of high stress within the backboard. The portion of the backboard face located within the triangle is substantially supported on three sides by the mounting structures, but the remainder of the face is not similarly surrounded by supports. To reinforce these exterior portions of the face, the offsets are positioned such that each side of the triangle is perpendicular to at least one ridge line, and is preferably perpendicular to several spaced-apart ridge lines.

Support throughout the backboard is also provided by positioning several of the ridge lines parallel to one another in one group and positioning additional ridge lines parallel to one another in a second group which is transverse to the first group. The backboard also includes a first ridge line, a second ridge line which is positioned perpendicular to the first ridge line, and a third ridge line which is transverse to both of the first two ridge lines.

Thus configured, the backboard is suitable for vigorous use. The offsets are positioned relative to one another and secured to the front and back layers such that the backboard has adequate strength and rigidity and provides uniform rebounds from the different points on the board's face. However, the backboards thus formed would tend to slip when stacked, so two additional structures are provided in the preferred embodiment. A stacking groove extends into the front layer near the perimeter, and corresponding stacking stubs extend from the back layer. The stacking stubs are capable of releasably engaging at least a portion of the stacking groove to assist in retaining the back layer of one backboard against the front layer of another backboard in a stack.

These and other features and advantages of the present invention will become more fully apparent through the following description and appended claims taken in conjunction with the accompanying drawings.

BRIEF DESCRIPTION OF THE DRAWINGS

In order that the manner in which the above-recited and other advantages and features of the invention are obtained, a more particular description of the invention summarized above will be rendered by reference to the appended drawings. Understanding that these drawings only provide a selected embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference is now made to the figures wherein like parts are referred to by like numerals. The present invention relates to a medium-to-large sized basketball backboard formed of a thermoplastic material such as polyethylene by a conventional molding process such as blow-molding using a novel mold.

Polyethylene has many favorable characteristics for use in basketball backboards. Polyethylene is relatively inexpensive both to obtain and to process. Polyethylene is also light-weight, weather-resistant, and sufficiently resilient to not dent easily. Moreover, polyethylene also has better impact-resistance than fiberglass.

In spite of these favorable characteristics, however, polyethylene has not been previously favored for use as the main structural component of medium-to-large sized basketball backboards because polyethylene is relatively flexible. Conventional polyethylene sheets are not rigid enough to provide a strong backboard that gives the consistent rebounds over a suitably large area unless such sheets are substantially thicker than equally rigid fiberglass or acrylic sheets. Moreover, forming hollow sheet or sandwich backboards with polyethylene has the disadvantages of hollow sheet and sandwich backboards discussed above.

However, the backboard of the present invention is formed in a shape which provides sufficient strength and rigidity for vigorous use of the backboard by children and adults even if the backboard is formed of relatively flexible material such as polyethylene.

Figure 1:
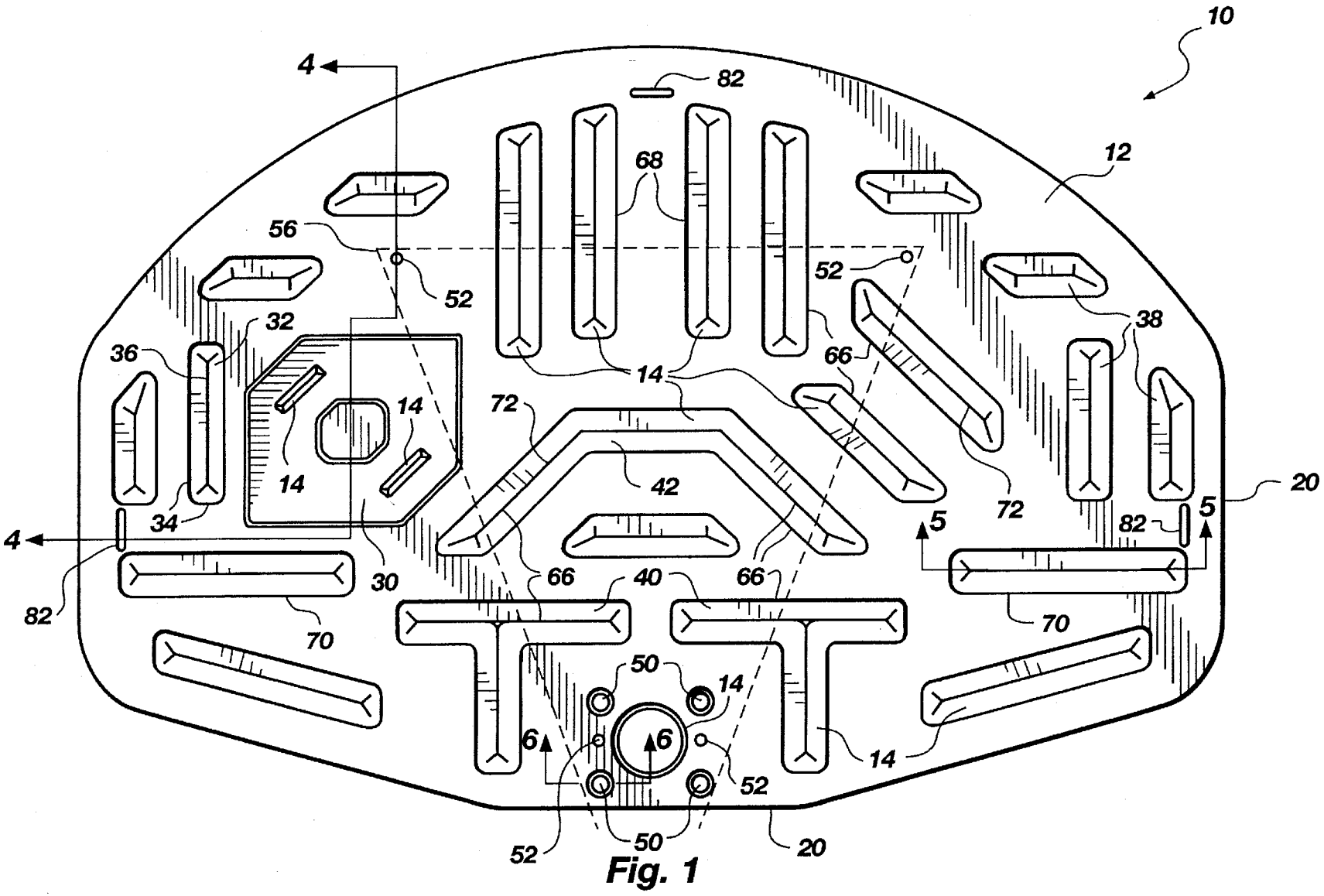
FIG. 1 is a rear plan view illustrating the back layer, offsets, and stacking stubs of a preferred embodiment of the backboard of the present invention, with stress lines indicated in phantom.

A presently preferred embodiment of the backboard is indicated generally at 10 in FIG. 1. With reference to the Figures indicated, the backboard 10 includes a back layer 12 (FIG. 1), a plurality of offsets 14 (FIG. 1), a front layer 16 having a face 18 (FIG. 2), and an edge wall 20 (FIG. 3). The back layer 12, offsets 14, front layer 16, and edge wall 20 are secured to one another and together define an interior volume 22 which is substantially filled with a fill material 24 (FIG. 5).

Figure 2:
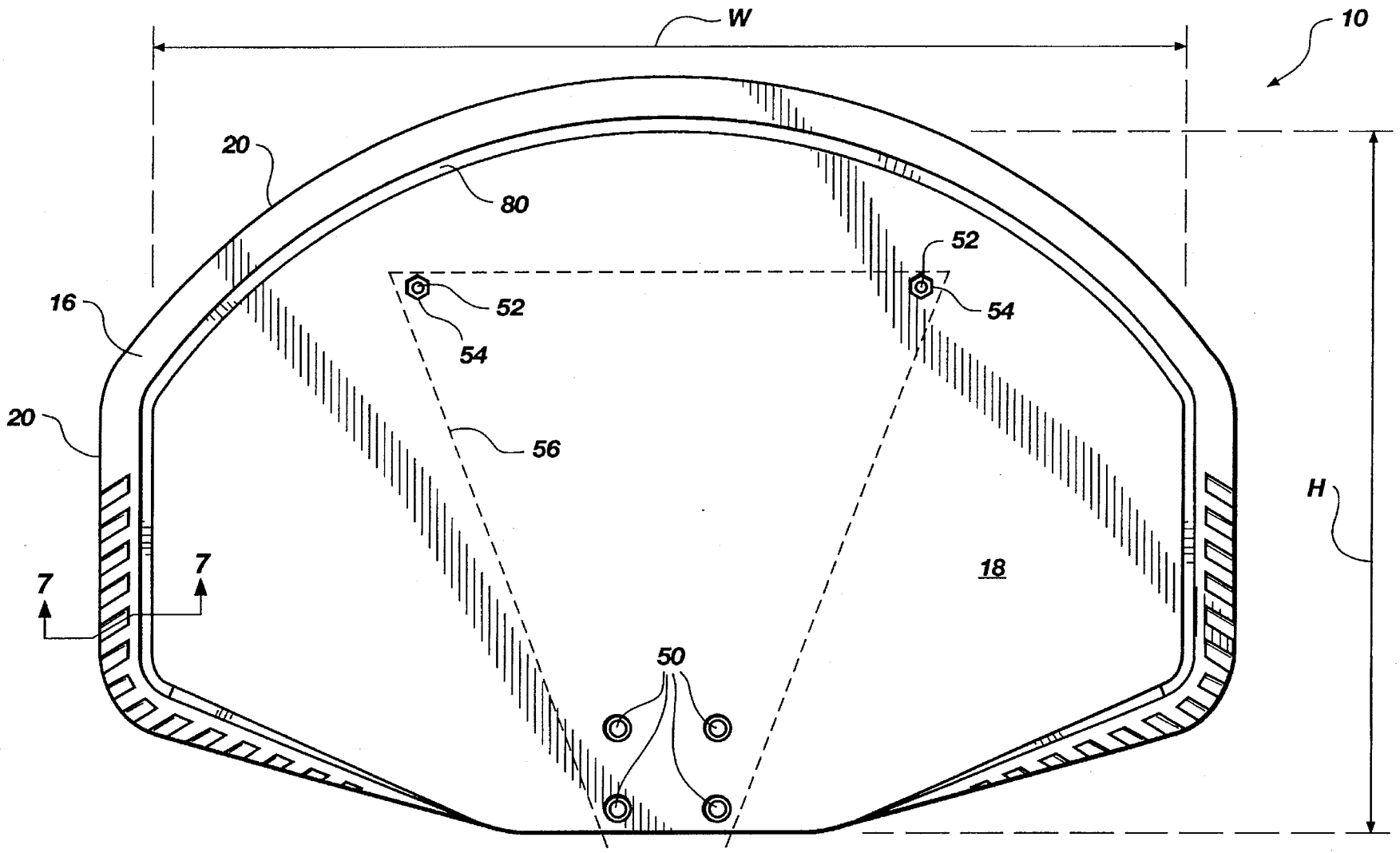
FIG. 2 is a front plan view illustrating the front layer, face, and stacking groove of the backboard shown in FIG. 1.
Figure 3:
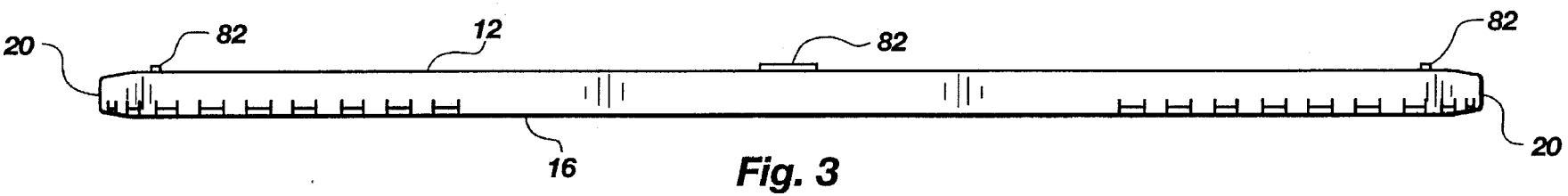
FIG. 3 is a bottom plan view of the backboard shown in FIG. 1, further illustrating the stacking stubs.

With reference to FIG. 2, the face 18 of the front layer 16 may be formed in various sizes. However, the face 18 is preferably in the medium-to-large size range. That is, the width of the widest portion of the face 18, indicated by the line labeled W, is preferably in the range from about 26 inches to about 54 inches, and the height of the tallest portion, indicated by the line labelled H, is preferably in the range from about 20 inches to about 36 inches.

It will be appreciated by those of skill in the art that a face 18 of the indicated size will not provide consistent rebounds and other function properly if formed merely from a sheet of polyethylene without any reinforcement. Thus, with reference to FIGS. 1 and 5, the back layer 12 is spaced apart from the front layer 16 by the offsets 14. As shown best in FIG. 1, the offsets 14 are spaced apart from one another, and are also spaced apart from the edge wall 20. The offsets are positioned to provide support throughout the face 18 (FIG. 2) of the backboard 10.

Figure 5:
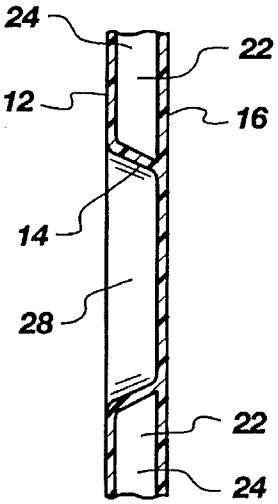
FIG. 5 is a cross-sectional view taken along line 5—5 in FIG. 1, further illustrating an offset.

As shown best in FIG. 5, one end of each offset 14 is homogeneously secured to the back layer 12 and the other end is homogeneously secured to the front layer 16. As used herein, a first structure is "homogeneously secured" to a second structure if there is no significant difference in materials as one moves from the first structure to a contiguous (i.e., touching) location in the second structure.

A "material" is a generally homogeneous substance or a generally uniform mixture of such substances. Thus, acrylic, fiberglass, polyethylene, and air each constitute a material. Polyurethane foam is a material because it is a generally uniform mixture of polyurethane and air. On the other hand, a layer of aluminum secured to a layer of polyurethane foam by an adhesive layer comprises three significantly different materials. One material is "significantly different" from another material if the two materials differ in their chemical composition, their method of manufacture or use, their structural strength, or in at least one other way which is important in the manufacture and use of basketball backboards. Materials which are not significantly different are said to be "substantially identical."

Two structures which were formed of polyethylene during one blow-molding process, which were allowed to connect while the polyethylene was not yet solid, and which have not subsequently been separated, are therefore homogeneously secured to one another. By contrast, a steel bolt which holds together two aluminum sheets is not homogeneously secured to either sheet because steel and aluminum are significantly different materials. Two layers of polyethylene connected by an intervening layer of adhesive are not homogeneously secured because they are not contiguous—they are prevented from touching by the intervening adhesive. Moreover, even if the sheets did touch, a significant difference in materials occurs as one moves into the region that is impregnated with adhesive.

With continued reference to FIG. 5, the preferred embodiment of the back layer 12 has substantially uniform thickness. In the embodiment shown, the thickness of both the back layer 12 and of the front layer 16 contiguous to the offsets 14 is about 100 thousandths of an inch, but those of skill in the art may readily determine other thicknesses for use in alternative embodiments.

Thus, the offsets 14 are preferably molded as deformations in an otherwise generally flat sheet of polyethylene. Each offset 14 accordingly defines a corresponding depression 28 in the back layer 12. In an alternative embodiment (not shown), the offsets are solid columns of polyethylene extending between the front layer and the back layer.

Figure 4:
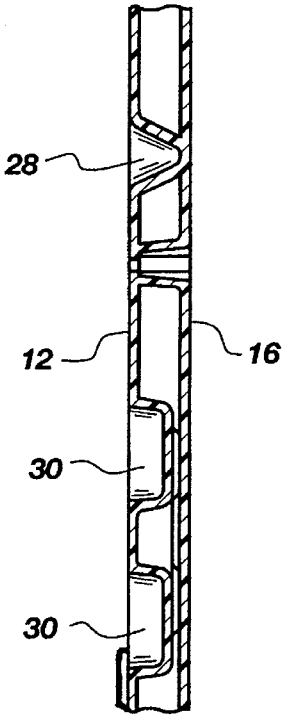
FIG. 4 is a cross-sectional view taken along line 4—4 in FIG. 1, illustrating an offset homogeneously connected to the back layer and to the front layer.

As shown in FIG. 4, the back layer 12 may also contain depressions 30 which are not formed by offsets 14. The particular depression 30 illustrated is configured for nesting engagement in a shipping container with a hollow ballast-fillable base for a portable basketball system such as that disclosed in U.S. Pat. No. 5,248,140.

As illustrated best in FIG. 1, a variety of differently shaped offsets 14 are employed in the backboard 10. The shape of an offset 14 refers generally to the shape of a ridge line or lines where the offset 14 is homogeneously secured to the back layer 12 or to the front layer 16. By way of example, in one particular offset 32, an annular ridge line 34 is defined where the offset 32 meets the back layer 12, and a single ridge line segment 36 is defined where the offset 32 meets the front layer 16 (FIG. 2).

The offset 32 is generally rectangular-shaped, but the backboard 10 also includes quadrilateral-shaped offsets 38, T-shaped offsets 40, and an arch-shaped offset 42. Those of skill in the art will appreciate that offsets in many other shapes may also be employed according to the teachings herein, including but not limited to circles, ovals, stars, polygons, and alphanumeric characters.

The offsets 14 have ridge lines located at positions which support the backboard's face 18 (FIG. 2) and provide the backboard 10 with consistent rebound capability. In particular, several ridge lines are positioned relative to positions designed for connecting the backboard 10 to a hoop and to a backboard support.

Figure 6:
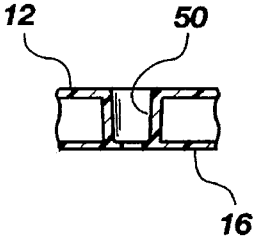
FIG. 6 is a cross-sectional view taken along line 6—6 in FIG. 1, further illustrating a mounting site for mounting the backboard to a backboard support.

For instance, a conventional basketball hoop (not shown) is typically suspended beneath most of the backboard's face 18 to serve as a target for the basketball (not shown). Two T-shaped offsets 40 are positioned alongside goal mounting apertures 50 which are provided in the backboard 10 for mounting the hoop to the backboard 10. The T-shaped offsets 40 provide structural strength to the backboard 10 around the hoop, which often receives more stress than other portions of the backboard 10. Importantly, the goal mounting apertures 50 are themselves offsets 14, as illustrated in the cross-sectional view of FIG. 6. The edge wall 20 provides additional reinforcement.

The backboard 10 is also typically mounted for use on a conventional backboard support (not shown) which suspends the backboard 10 above the playing surface. The backboard support may be a pole permanently mounted in the ground, a pole connected to a hollow ballast-fillable base such as the base described in U.S. Pat. No. 5,259,612 to Matherne et al., a pole connected to a wall, or another structure capable of holding the backboard 10 in a substantially upright position during competitive or recreational basketball play. The backboard support typically includes a conventional bracket, bolts, and other structures (not shown) for securing the backboard 10 to the support.

As shown in FIGS. 1 and 2, the backboard 10 contains at least three mounting sites 52 for mounting the backboard 10 to a backboard support (not shown). The mounting sites 52 include bolt holes through the back layer 12 and the front layer 16. The front layer 16 portion of each mounting site 52 has a hexagonal cavity 54 for receiving, retaining, and preventing rotation of the head of a bolt (not shown) used to secure the backboard 10 to the backboard support.

The mounting sites 52 define a triangle 56 whose sides correspond to lines of high stress within the backboard 10. The portion of the backboard face 18 located within the triangle 56 is substantially supported on three sides by the bracket and other mounting structures, but the remainder of the face 18 is not similarly surrounded by supports. To reinforce these exterior portions of the face 18, the offsets 14 are positioned such that each side of the triangle 56 is perpendicular to at least one ridge line, and is preferably perpendicular to several spaced-apart ridge lines. Thus, several ridge lines 66 are substantially perpendicular to the triangle 56.

Support throughout the backboard 20 is also provided by positioning several ridge lines 68 parallel to one another in one group and positioning additional ridge lines 70 parallel to one another in a second group which is transverse to the first group. The backboard 10 also includes a first ridge line 68, a second ridge line 70 which is positioned perpendicular to the first ridge line 68, and a third ridge line 72 which is transverse to both of the first two ridge lines 68 and 70. Orienting the offsets thus at different angles decreases the risk that the backboard 10 will flex or bend excessively along a line because each line from one edge of the backboard 10 to another edge is more likely to be transverse to at least one offset 14.

Figure 7:
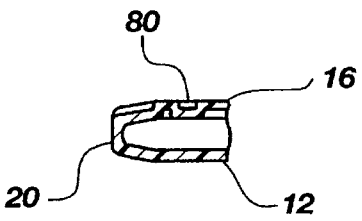
FIG. 7 is a cross-sectional view taken along line 7—7 in FIG. 2, further illustrating the stacking groove.

Additional strength and rigidity is provided by the edge wall 20 which is located at the perimeter of the backboard 10 as illustrated best in FIGS. 3 and 7. The edge wall 20 is preferably homogeneously secured to both the back layer 12 and to the front layer 16. The edge wall 20 is also preferably annular.

As shown in FIG. 5, the interior volume 22 of the backboard holds a fill material 24. The presently preferred fill material 24 is air at ambient pressure. In an alternative embodiment, the fill material 24 includes polyurethane foam. Regardless of whether air, polyurethane foam, or another material is used, the interior volume 22 is substantially filled with a material that is principally formed of a significantly different material than the front layer 16 and the back layer 12. A structure "is principally formed of" a given material if at least 80 percent of the structure by weight is the given material. Thus, neither a mere solid sheet of material nor a mere sandwich of materials provides a backboard according to the teachings herein. Rather, the backboard must comprise offsets separating a front layer from a back layer to define an interior volume, and must otherwise conform to the teachings of the present invention.

To facilitate stacking multiple backboards such as the backboard 10 illustrated, a stacking groove 80 extends into the front layer 16 near its perimeter as shown in FIGS. 2 and 7. Several corresponding stacking stubs 82 extend from the back layer 12 as shown in FIGS. 1 and 3. The stacking stubs 82 are capable of releasably engaging at least a portion of the stacking groove 80 to assist in retaining the back layer 12 of one backboard against the front layer 16 of another backboard in a stack.

Alternative embodiments may employ releasably engageable stacking notches rather than a long stacking groove, and may employ two or more notches and corresponding stubs. Alternative embodiments may also employ one or more stacking notches and corresponding stubs which restrict movement in at least two directions. Such notches may be X-shaped, square, or any of a variety of other shapes.

Although high-density copolymer polyethylene is the presently preferred material for constructing the back layer 12, offsets 14, front layer 16, and edge wall 20, those of skill in the art will appreciate that a variety of other thermoplastic materials may also be used, including but not limited to, low density polyethylene, homopolymer polyethylene, polypropylene, ABS blends, and the material sold under the mark NORYL owned by General Electric Co. Thermoset materials may also be molded or otherwise shaped into backboards according to the present invention.

The polyethylene used to form the backboard 10 is easily shaped into the novel form disclosed here by conventional blow-molding, compression-molding, injection-molding, and similar known shaping processes. It is presently preferred that the backboard be blow-molded, and that the offsets be homogeneously secured to the front layer by compression-molding. Although the processes used to form the backboard are known, they necessarily employ a novel mold (not shown) which corresponds in shape to the backboard of the present invention. An appropriate mold is readily shaped by those of skill in the art to form the back layer, front layer, offsets, and other structures described here.

The backboard of the present invention is suitable for vigorous use during indoor or outdoor play. The polyethylene used to form the backboard provides better impact-resistance than fiberglass at a comparable weight and cost. The offsets are positioned relative to one another and secured to the front and back layers such that the backboard has adequate strength and rigidity and provides uniform rebounds from the different points on the board's face.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated by the appended claims rather than by the foregoing description. All changes which come within the meaning and range of equivalency of the claims are to be embraced within their scope.

What is claimed and desired to be secured by patent is:

1. A basketball backboard comprising a front layer, a back layer, a plurality of offsets, and a fill material, wherein:

said front layer has a relatively flat face configured for receiving the impact of a basketball;

said back layer is spaced apart from said front layer by said offsets such that said front layer, said back layer, and said offsets substantially define an interior volume;

each of said offsets defines a corresponding depression in the back layer and each of said offsets has a front end which is homogeneously secured to said front layer and also has a back end which is homogeneously secured to said back layer;

said fill material substantially fills said interior volume, and said fill material is principally formed of a significantly different material than the material of said front layer and the material of said back layer.

2. The backboard of claim 1, further comprising:

at least one stacking notch extending into one of said front layer and said back layer; and at least one stacking stub extending outwardly from the other of said front layer and said back layer, said stacking stub being capable of releasably engaging said stacking notch to thereby assist in retaining a back layer of a first said backboard in position adjacent a front layer of a second said backboard in a stack of said backboards.

3. The backboard of claim 1, further comprising a substantially peripheral edge wall secured to said front layer adjacent the perimeter of said front layer and secured to said back layer adjacent the perimeter of said back layer.

4. The backboard of claim 3, wherein said edge wall is homogeneously secured to said front layer and is also homogeneously secured to said back layer.

5. The backboard of claim 1, wherein said front layer and said back layer are principally formed of substantially identical materials.

6. The backboard of claim 1, wherein said front layer and said back layer each are principally formed of a thermoplastic material.

7. The backboard of claim 1, wherein said front layer and said back layer each are principally formed of polyethylene.

8. The backboard of claim 1, wherein said front layer, said back layer, and said offsets each are principally formed of blow-molded polyethylene.

9. The backboard of claim 1, wherein said fill material comprises air.

10. The backboard of claim 1, wherein said fill material comprises polyurethane foam.

11. The backboard of claim 1, wherein said backboard further comprises at least three spaced apart mounting sites adjacent said back layer for mounting said backboard to a backboard support, and said mounting sites define a triangle.

12. The backboard of claim 11, wherein each of said offsets is homogeneously secured to said front layer at least along a straight ridge line, and each of the three sides of the triangle defined by said mounting sites is positioned substantially perpendicular to at least one of said ridge lines.

13. The backboard of claim 1, wherein each of said offsets is spaced apart from every other of said offsets.

14. The backboard of claim 1, wherein said back layer is substantially symmetric about a center line, and said center line is generally vertical if said backboard is mounted and positioned for use.

15. The backboard of claim 1, wherein at least one straight line from one point on an edge of said face to another point on the edge of said face measures at least about thirty inches in length.

16. The backboard of claim 1, wherein at least one straight line from one point on an edge of said face to another point on the edge of said face measures at least about forty inches in length.

17. A basketball backboard comprising a front layer, a back layer, a plurality of offsets, a plurality of mounting sites, an edge wall, and a fill material, wherein:

said front layer has a relatively flat face configured for receiving the impact of a basketball, said front layer and said back layer are principally formed of substantially identical materials;

said back layer is spaced apart from said front layer by said offsets such that said front layer, said back layer, said edge wall, and said offsets substantially define an interior volume;

each of said offsets defines a corresponding depression in the back layer and each of said offsets has a front end which is homogeneously secured to said front layer and also has a back end which is homogeneously secured to said back layer;

said mounting sites comprise at least three spaced apart mounting sites adjacent said back layer for mounting said backboard to a backboard support, said mounting sites define a triangle;

said edge wall is a substantially peripheral edge wall homogeneously secured to said front layer adjacent the perimeter of said front layer and homogeneously secured to said back layer adjacent the perimeter of said back layer;

said fill material substantially fills said interior volume, and said fill material is principally formed of a significantly different material than the material of said front layer and the material of said back layer.

18. The backboard of claim 17, further comprising:

a stacking groove extending into said front layer; and at least two stacking stubs extending outwardly from said back layer, said stacking stubs being capable of releasably engaging said stacking groove to thereby assist in retaining a back layer of a first said backboard in position adjacent a front layer of a second said backboard in a stack of said backboards.

19. The backboard of claim 17, wherein each of said mounting sites comprises an aperture through said back layer which is aligned with an aperture through said front layer.

20. The backboard of claim 17, wherein each side of the triangle is separated from the other two sides of the triangle by an angle of at least about 30 degrees.

21. The backboard of claim 17, wherein the boundary between said back layer and at least one of said offsets is substantially quadrilateral in shape.

22. The backboard of claim 17, wherein each of said offsets is homogeneously secured to said front layer at least along a straight ridge line.

23. The backboard of claim 22, wherein said ridge lines of a plurality of said offsets are positioned parallel to one another.

24. The backboard of claim 22, wherein said ridge lines of a first plurality of said offsets are positioned parallel to a first axis, said ridge lines of a second plurality of said offsets are positioned parallel to a second axis, and the first axis is transverse to the second axis.

25. The backboard of claim 22, wherein said ridge line of a first of said offsets and said ridge line of a second of said offsets are positioned substantially perpendicular to one another, and said ridge line of a third of said offsets is positioned transverse to said ridge lines of said first and second offsets.

26. The backboard of claim 22, wherein at least two of said ridge lines are positioned to form a T-shaped ridge.

27. The backboard of claim 22, wherein said backboard has at least one goal mounting aperture for mounting a basketball goal to said backboard.

28. The backboard of claim 27, wherein said backboard comprises ridge lines positioned to form at least two T-shaped ridges positioned alongside said goal mounting aperture.

29. A basketball backboard comprising a front layer, a back layer, a plurality of offsets, a plurality of mounting sites, an edge wall, and a fill material, wherein:

said front layer has a relatively flat face configured for receiving the impact of a basketball, said front layer has a stacking groove extending into said front layer, said front layer and said back layer are principally formed of substantially identical materials;

said back layer is spaced apart from said front layer by said offsets such that said front layer, said back layer has at least two stacking stubs extending outwardly from said back layer, said stacking stubs are capable of releasably engaging said stacking groove to thereby assist in retaining a back layer of a first said backboard in position adjacent a front layer of a second said backboard in a stack of said backboards, said back layer, said edge wall, and said offsets substantially define an interior volume;

each of said offsets defines a corresponding depression in the back layer and each of said offsets has a front end which is homogeneously secured to said front layer at least along a straight ridge line, each of said offsets also has a back end which is homogeneously secured to said back layer;

said mounting sites comprise at least three spaced apart mounting sites adjacent said back layer for mounting said backboard to a backboard support, said mounting sites define a triangle;

said edge wall is a substantially peripheral edge wall homogeneously secured to said front layer adjacent the perimeter of said front layer and homogeneously secured to said back layer adjacent the perimeter of said back layer;

said fill material substantially fills said interior volume, and said fill material is principally formed of a significantly different material than the material of said front layer and the material of said back layer.

30. The backboard of claim 29, wherein said front layer, said back layer, and said offsets each are principally formed of blow-molded polyethylene.

31. The backboard of claim 29, wherein said fill material comprises air.

32. The backboard of claim 29, wherein at least one straight line from one point on an edge of said face to another point on an edge of said face measures at least about thirty-five inches in length.

33. The backboard of claim 29, wherein said offsets are spaced apart from one another, said ridge line of a first of said offsets and said ridge line of a second of said offsets are positioned substantially perpendicular to one another, and said ridge line of a third of said offsets is positioned transverse to said ridge lines of said first and second offsets.

34. The backboard of claim 29, wherein each of the three sides of the triangle defined by said mounting sites is positioned substantially perpendicular to at least one of said ridge lines.

35. The backboard of claim 29, wherein each of the three sides of the triangle defined by said mounting sites is positioned substantially perpendicular to a plurality of said ridge lines.

* * * * *